US011303003B2

(12) United States Patent
Maruyama et al.

(10) Patent No.: US 11,303,003 B2
(45) Date of Patent: Apr. 12, 2022

(54) WAVEGUIDE MICROSTRIP LINE CONVERTER

(71) Applicant: Mitsubishi Electric Corporation, Chiyoda-ku (JP)

(72) Inventors: Takashi Maruyama, Tokyo (JP); Shigeo Udagawa, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 343 days.

(21) Appl. No.: 16/341,296

(22) PCT Filed: Jun. 30, 2017

(86) PCT No.: PCT/JP2017/024176
§ 371 (c)(1),
(2) Date: Apr. 11, 2019

(87) PCT Pub. No.: WO2018/116506
PCT Pub. Date: Jun. 28, 2018

(65) Prior Publication Data

US 2021/0288391 A1 Sep. 16, 2021

(30) Foreign Application Priority Data

Dec. 21, 2016 (JP) ..... PCT/JP2016/088155

(51) Int. Cl.
*H01P 5/107* (2006.01)
*H01Q 21/00* (2006.01)

(52) U.S. Cl.
CPC ..... *H01P 5/107* (2013.01); *H01Q 21/0037* (2013.01); *H01Q 21/0075* (2013.01)

(58) Field of Classification Search
CPC . H01P 5/107; H01Q 21/0037; H01Q 21/0075
(Continued)

(56) References Cited

U.S. PATENT DOCUMENTS 4,716,386 A * 12/1987 Lait ..... H01P 5/107 333/26
2002/0097109 A1 7/2002 du Toit et al.

FOREIGN PATENT DOCUMENTS

JP 2010-56920 A 3/2010
JP 2013-190230 A 9/2013

OTHER PUBLICATIONS

International Search Report dated Sep. 19, 2017 in PCT/JP2017/024176 filed on Jun. 30, 2017.
(Continued)

*Primary Examiner* — Stephen E. Jones
*Assistant Examiner* — Kimberly E Glenn
(74) *Attorney, Agent, or Firm* — Oblon, McClelland, Maier & Neustadt, L.L.P.

(57) ABSTRACT

A waveguide microstrip line converter includes a dielectric substrate, a ground conductor, and a line conductor. The ground conductor is provided on a first surface of the dielectric substrate and is joined to an open end that is an end portion of the waveguide. The slot is formed in a region surrounded by an opening edge portion of the open end of the ground conductor. The line conductor is provided on a second surface of the dielectric substrate. The line conductor includes first portions that are the microstrip lines, a second portion located just above the slot, and third portions responsible for impedance matching between the first portions and the second portion. The third portions each include an impedance transforming unit that is a portion having a wider line width than the first portions.

20 Claims, 10 Drawing Sheets

(58) Field of Classification Search
USPC ..... 333/26
See application file for complete search history.

(56) References Cited

OTHER PUBLICATIONS

International Search Report dated Mar. 21, 2017 in PCT/JP/2016/088155 filed on Dec. 21, 2016.

* cited by examiner

WAVEGUIDE MICROSTRIP LINE CONVERTER

FIELD

The present invention relates to a waveguide microstrip line converter capable of mutually converting power propagating through a waveguide and power propagating through a microstrip line.

BACKGROUND

Waveguide microstrip line converters connect waveguides and microstrip lines and transmit signals from the waveguides to the microstrip lines or from the microstrip lines to the waveguides. The waveguide microstrip line converters are widely used in antenna devices that transmit high-frequency signals in a microwave band or millimeter wave band.

A waveguide microstrip line converter is conventionally known in which a ground conductor is provided on one of both surfaces of a dielectric substrate and a microstrip line is provided on the other surface thereof. An open end of the waveguide is connected to the ground conductor. Patent Literature 1 discloses a waveguide microstrip line converter in which a ground conductor and a conductor plate connected to a microstrip line are electrically connected via a conductive structure embedded in a dielectric substrate. The conductive structure is formed by a plurality of through holes arranged so as to surround an open end of a waveguide.

CITATION LIST

Patent Literature

Patent Literature 1: Japanese Patent Application Laid-open No. 2010-56920

SUMMARY

Technical Problem

Waveguide microstrip line converters are required to stably obtain high electric performance and to enhance reliability.

The present invention has been made in view of the above, and it is an object of the present invention to obtain a waveguide microstrip line converter that can stably obtain high electric performance and improve reliability.

Solution to Problem

In order to solve the above problems and achieve the object, a waveguide microstrip line converter of the present invention can mutually convert power propagating through a waveguide and power propagating through a microstrip line. The waveguide microstrip line converter includes a dielectric substrate, a ground conductor, a slot, and a line conductor. The ground conductor is provided on a first surface of the dielectric substrate and is joined to an open end that is an end portion of the waveguide. The slot is formed in a region surrounded by an opening edge portion of the open end of the ground conductor. The line conductor is provided on a second surface of the dielectric substrate. The line conductor includes first portions that are the microstrip lines, a second portion located just above the slot, and third portions responsible for impedance matching between the first portions and the second portion. The third portions each include an impedance transforming unit that is a portion having a wider line width than the first portions.

Advantageous Effects of Invention

The waveguide microstrip line converter according to the present invention achieves an effect of stably obtaining high electric performance and improving reliability.

DESCRIPTION OF EMBODIMENTS

Hereinafter, a waveguide microstrip line converter according to each embodiment of the present invention will be described in detail with reference to the drawings. The present invention is not limited to the embodiments.

First Embodiment

Figure 1:
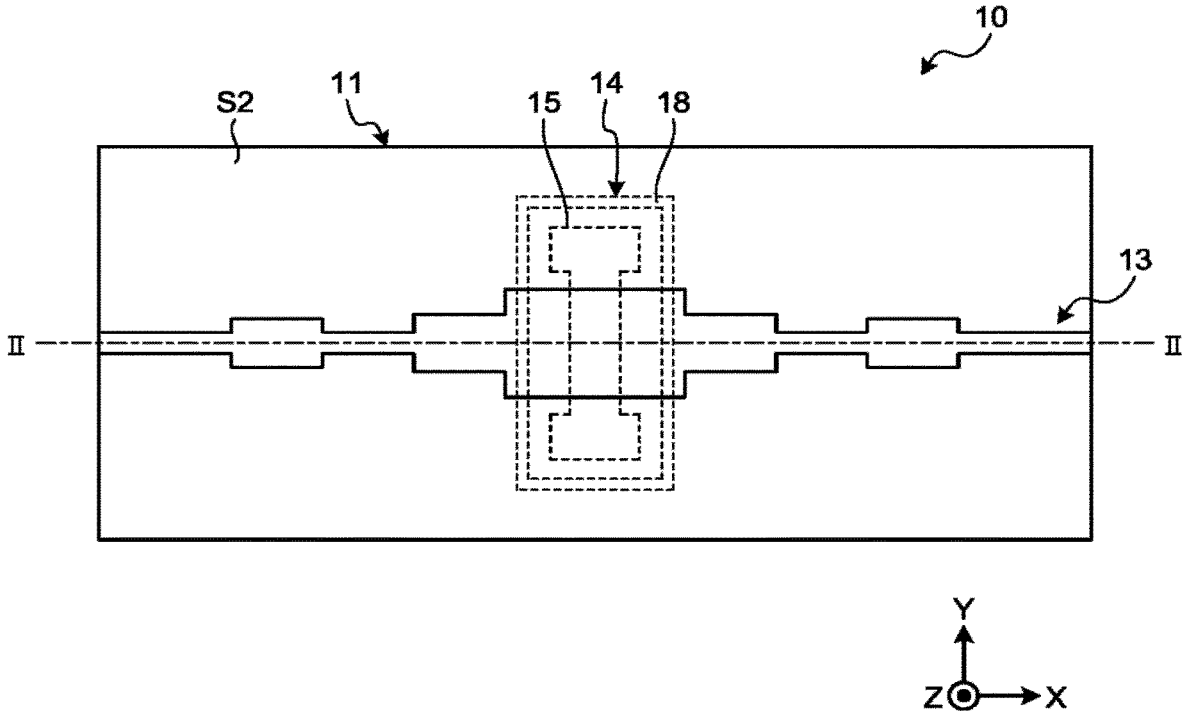
FIG. 1 is a top view illustrating an appearance configuration of a waveguide microstrip line converter according to a first embodiment.
Figure 2:
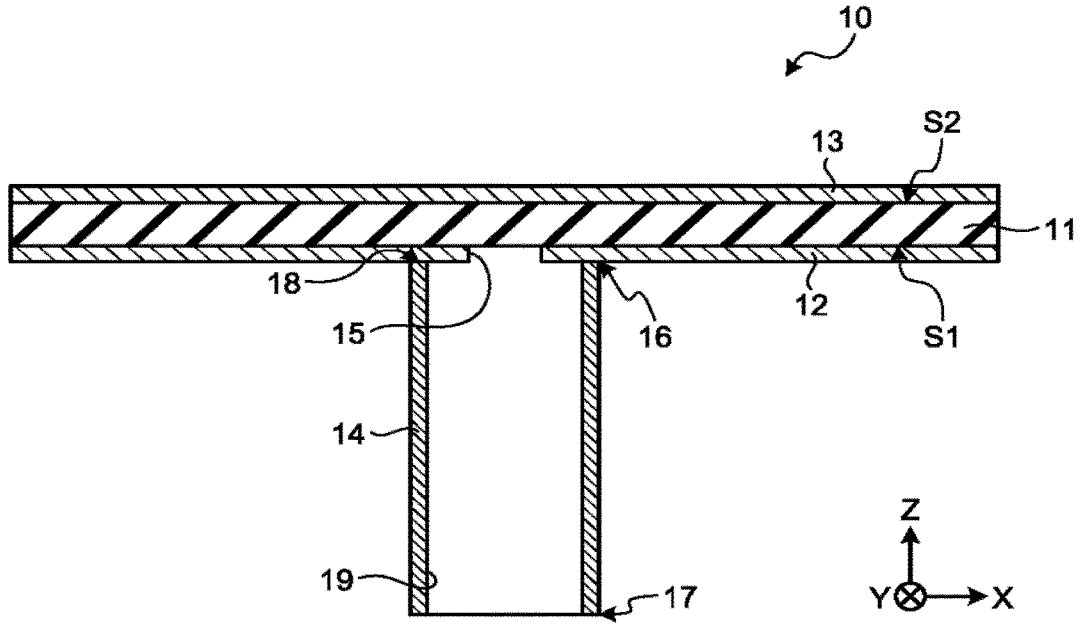
FIG. 2 is a cross-sectional view illustrating an internal configuration of the waveguide microstrip line converter according to the first embodiment.

FIG. 1 is a top view illustrating an appearance configuration of a waveguide microstrip line converter 10 according to a first embodiment. FIG. 2 is a cross-sectional view illustrating an internal configuration of the waveguide microstrip line converter 10. In FIG. 1, a configuration provided in the depth of the paper surface behind a configuration indicated by a solid line is indicated by a broken line. FIG. 2 illustrates a cross-sectional configuration taken along a line II-II illustrated in FIG. 1. An X axis, a Y axis, and a Z axis are three axes perpendicular to one another. A direction parallel to the Y axis is a Y-axis direction that is a first direction, a direction parallel to the X axis is an X-axis direction that is a second direction, and a direction parallel to the Z axis is a Z-axis direction that is a third direction. In the X-axis direction, a direction indicated by an arrow in the figure is a plus X direction and a direction opposite to the plus X direction is a minus X direction. This applies to the Y-axis direction and the Z-axis direction, similarly to the X-axis direction.

The waveguide microstrip line converter 10 can mutually convert power propagating through a waveguide 14 and power propagating through a microstrip line. The waveguide 14 and the microstrip line are transmission paths through which high-frequency signals are transmitted. The waveguide microstrip line converter 10 includes a dielectric substrate 11, a ground conductor 12 joined to an end portion of the waveguide 14, and a line conductor 13 including a microstrip line.

The ground conductor 12 is provided on a first surface S1 of the dielectric substrate 11. The line conductor 13 is provided on a second surface S2 of the dielectric substrate 11. Both of the first surface S1 and the second surface S2 are parallel to the X axis and the Y axis. A tube-axis direction of the waveguide 14 is the Z-axis direction. A tube axis is a center line of the waveguide 14. In the line conductor 13, a line width represents a width of a transmission path in the Y-axis direction, and a line length represents a length of the transmission path in the X-axis direction.

Figure 3:
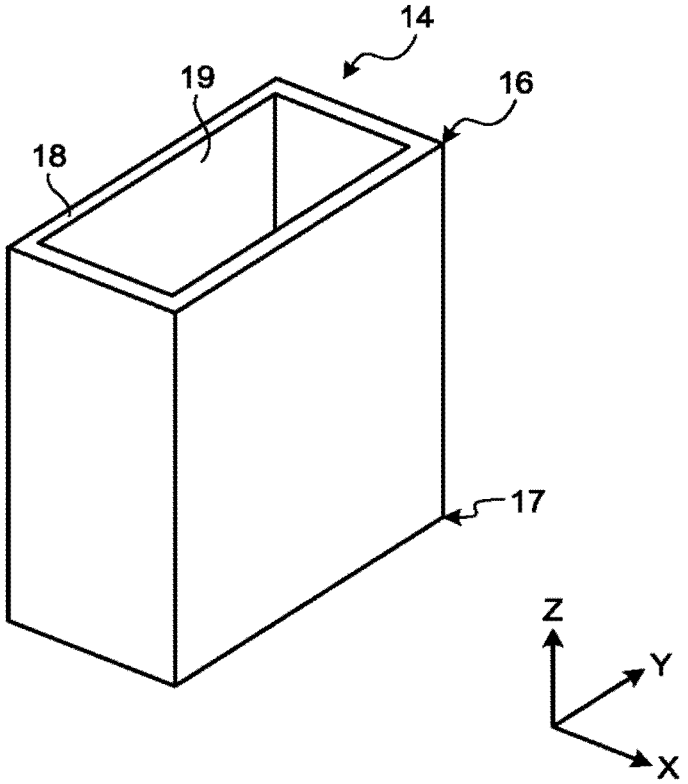
FIG. 3 is a perspective view illustrating an appearance configuration of a waveguide illustrated in FIG. 2.

FIG. 3 is a perspective view illustrating an appearance configuration of the waveguide 14. The waveguide 14 is a rectangular waveguide having a rectangular XY cross section, and is made of a hollow metal tube. The XY cross section of the waveguide 14 is a rectangle having long sides parallel to the Y axis and short sides parallel to the X axis. In the waveguide 14, an electromagnetic wave propagates through an internal space surrounded by a tube wall 19 made of a metal material. An open end 16 is one end portion of the waveguide 14 in the tube-axis direction and includes an opening edge portion 18 that has the same shape as the XY cross section of the waveguide 14. The opening edge portion 18 is a short circuit surface connected to the ground conductor 12. Through an input/output end 17 that is the other end portion of the waveguide 14 in the tube-axis direction, a high-frequency signal to be transmitted through the waveguide 14 is input, or a high-frequency signal that has been transmitted through the waveguide 14 is output.

In the first embodiment, the configuration of the waveguide 14 is arbitrary. The waveguide 14 may include, instead of the tube wall 19 made of a metal material, a dielectric substrate including a large number of through holes formed therein. The waveguide 14 may be one in which the inside surrounded by the tube wall 19 is filled with a dielectric material. The waveguide 14 may be a waveguide having a shape with a curved corner in the XY cross section, or a ridge waveguide.

The dielectric substrate 11 is a flat plate member made of a resin material. The ground conductor 12 is provided on the entire first surface S1 of the dielectric substrate 11. The slot 15 is formed in an XY region surrounded by the opening edge portion 18 of the open end 16 of the ground conductor 12. The line conductor 13 is provided on the second surface S2 of the dielectric substrate 11 so as to pass just above an opening of the waveguide 14. In one example, the ground conductor 12 is formed by crimping a copper foil, which is a conductive metal foil, on the first surface S1. The line conductor 13 is formed by patterning a copper foil crimped on the second surface S2. The ground conductor 12 and the line conductor 13 may be metal plates molded in advance and then attached to the dielectric substrate 11.

Figure 4:
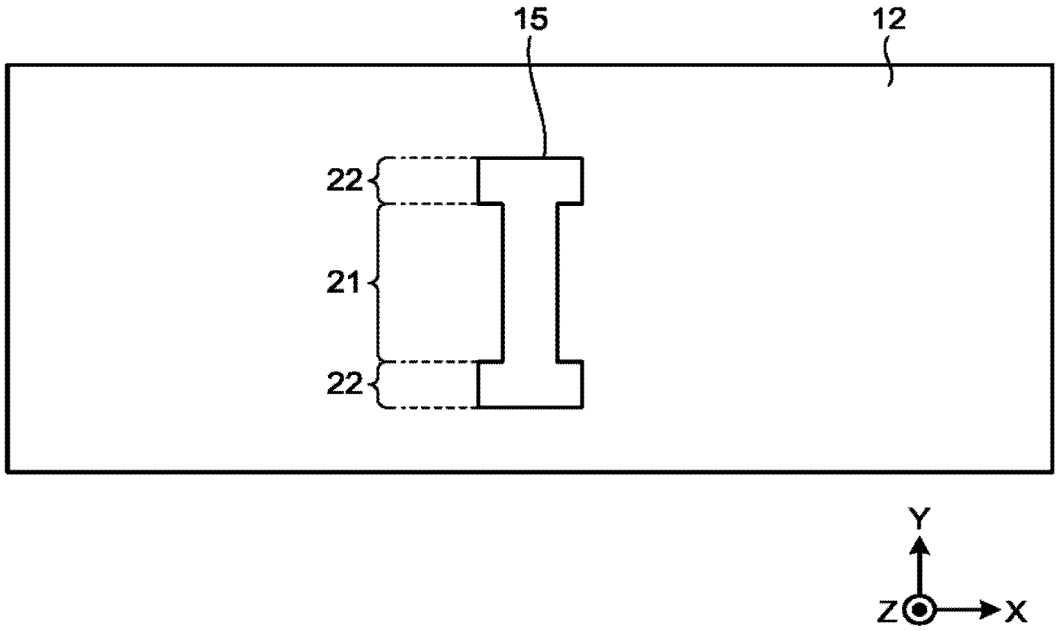
FIG. 4 is a plan view of a ground conductor illustrated in FIG. 2.

FIG. 4 is a plan view of the ground conductor 12. The slot 15 is an opening formed by removing a part of the ground conductor 12. The slot 15 has a planar shape that is longer in the Y-axis direction than in the X-axis direction. The slot 15 has end portions 22 located at both ends in the Y-axis direction and a central portion 21 between the end portions 22. A width of each end portion 22 in the X-axis direction is wider than a width of the central portion 21 in the X-axis direction. The shape of the slot 15 illustrated in FIG. 4 is appropriately referred to as an "H shape". The central portion 21 is located just under the line conductor 13.

By setting the width of each end portion 22 in the X-axis direction wider than the width of the central portion 21, an electric field at the end portions 22 is weakened, whereas an electric field at the central portion 21 is strengthened. An electromagnetic coupling between the open end 16 of the waveguide 14 and the line conductor 13 is strengthened by strengthening the electric field at the central portion 21 of the slot 15, the central portion 21 being located just under the line conductor 13. Thus, the waveguide microstrip line converter 10 can efficiently exchange power between the waveguide 14 and the line conductor 13.

Figure 5:
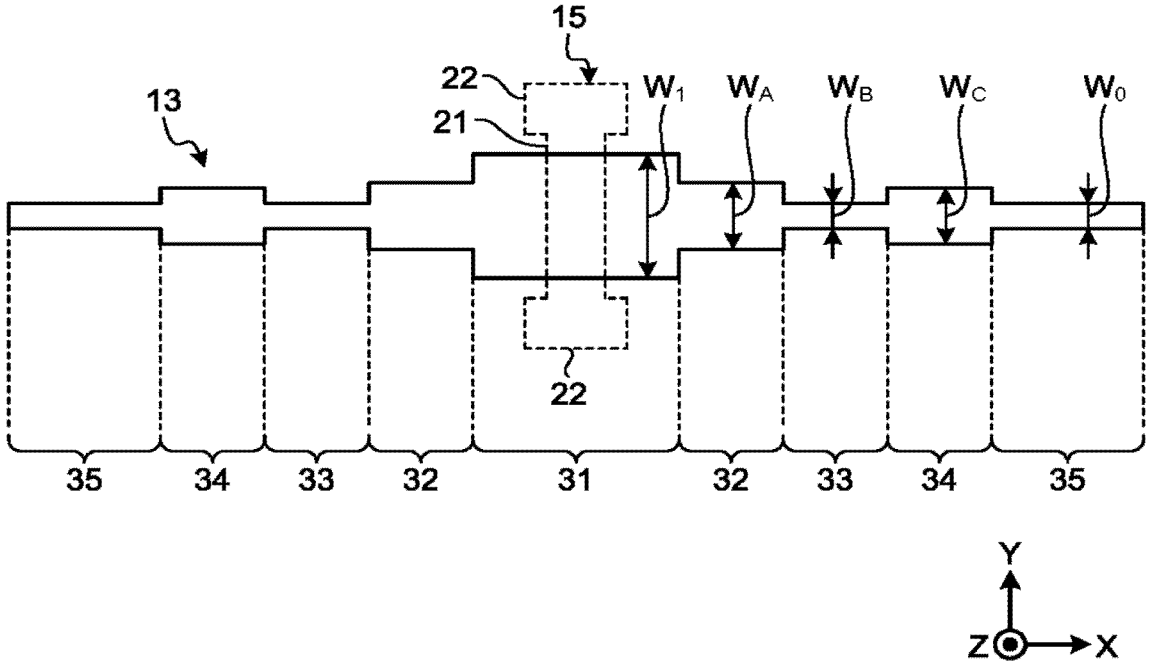
FIG. 5 is a plan view of a line conductor of the first embodiment.

FIG. 5 is a plan view of the line conductor 13. In FIG. 5, as a reference, the slot 15 is indicated by a broken line. The line conductor 13 includes first portions that are microstrip lines 35, a second portion that is a conversion unit 31 located just above the slot 15, and third portions between the first portions and the second portion. The third portions each include first, second and third impedance transforming units 32, 34, and 33 that are multiple impedance transforming units responsible for impedance matching between the microstrip line 35 and the conversion unit 31. In the example of FIG. 5, the third portions are each constituted by the first impedance transforming unit 32, the second impedance transforming unit 34, and the third impedance transforming unit 33.

The conversion unit 31, the first, second and third impedance transforming units 32, 34, and 33, and the microstrip lines 35 are made of a metal foil or a metal plate that is a one-piece metal member. The conversion unit 31, the first, second, and third impedance transforming units 32, 34, and 33, and the microstrip lines 35 are formed such that the line widths thereof are different between adjacent portions. The microstrip lines 35 have a line width $W_0$ and are located at both ends of the line conductor 13 in the X-axis direction. A line length of the microstrip line 35 is arbitrary.

The conversion unit 31 has a line width $W_1$ and is located at the center of the line conductor 13 in the X-axis direction. The conversion unit 31 is a portion of the line conductor 13 responsible for power conversion between the waveguide 14 and the line conductor 13. The line width $W_1$ of the conversion unit 31 is wider than the line width $W_0$ of the microstrip lines 35. A relationship of $W_1>W_0$ holds between the line width $W_1$ and the line width $W_0$. Assuming that a wavelength of a high-frequency signal transmitted through the line conductor 13 is $\lambda$, a length of the conversion unit 31 in the X-axis direction corresponds to $\lambda/2$. The first impedance transforming units 32 have a line width $W_A$ and are located on both sides of the conversion unit 31. The line width $W_A$ of the first impedance transforming units 32 is wider than the line width $W_0$ of the microstrip lines 35 and narrower than the line width $W_1$ of the conversion unit 31. A relationship of $W_1>W_A>W_0$ holds among the line width $W_A$, the line width $W_0$, and the line width $W_1$.

The second impedance transforming units 34 and the third impedance transforming units 33 are located between the first impedance transforming units 32 and the microstrip lines 35. The third impedance transforming units 33 have a line width $W_B$ and are located next to the first impedance transforming units 32. The line width $W_B$ of the third impedance transforming units 33 is equal to the line width $W_0$ of the microstrip lines 35 and narrower than the line width $W_A$ of the first impedance transforming units 32. A relationship of $W_A>W_B=W_0$ holds among the line width $W_B$, the line width $W_0$, and the line width $W_A$.

The second impedance transforming units 34 have a line width $W_C$ and are located between the third impedance transforming units 33 and the microstrip lines 35. The line width $W_C$ of the second impedance transforming units 34 is wider than both the line width $W_B$ of the third impedance transforming units 33 and the line width $W_0$ of the microstrip lines 35. The line width $W_C$ of the second impedance transforming units 34 is narrower than the line width $W_A$ of the first impedance transforming units 32. A relationship of $W_A>W_C>W_B=W_0$ holds among the line width $W_C$, the line width $W_B$, the line width $W_0$, and the line width $W_A$. The line widths $W_A$ and $W_C$ of the first and second impedance transforming units 32 and 34 that are two of the third portions are wider than the line width $W_0$ of the microstrip lines 35 that are the first portions. In addition, the line widths $W_A$ and $W_C$ of the first and second impedance transforming units 32 and 34 are narrower than the line width $W_1$ of the conversion unit 31 that is the second portion. A relationship of $W_1>W_A>W_C>W_0$ holds among the line width $W_A$, the line width $W_C$, the line width $W_0$, and the line width $W_1$. Line lengths of the first, second, and third impedance transforming units 32, 34, and 33 correspond to $\lambda/4$.

Next, an operation of the waveguide microstrip line converter 10 will be described with reference to FIGS. 1 to 5. Here, a case where the high-frequency signal that has been transmitted through the waveguide 14 is transmitted to the microstrip line 35 is taken as an example.

The electromagnetic wave that has propagated inside the waveguide 14 reaches the ground conductor 12. The electromagnetic wave that has reached the ground conductor 12 propagates through the slot 15 to the conversion unit 31. What is meant by that the electromagnetic wave propagates to the conversion unit 31 includes generation of energy of the electromagnetic wave between the ground conductor 12 and the conversion unit 31. The electromagnetic wave that has propagated to the conversion unit 31 propagates toward the two microstrip lines 35. The waveguide microstrip line converter 10 outputs a high-frequency signal to be transmitted in the plus X direction from one microstrip line 35 and outputs a high-frequency signal to be transmitted in the minus X direction from the other microstrip line 35. The phases of the high-frequency signals output from the both microstrip lines 35 are opposite to each other.

Conventionally, a configuration is known in which a fine gap is provided in a conductor at a portion corresponding to the conversion unit 31 to divide the line, and a high-frequency signal is transmitted by an electromagnetic coupling. An error may occur in line length when there is poor machining of the gap. On the other hand, in the line conductor 13 of the first embodiment, each portion from the conversion unit 31 to the microstrip lines 35 is made of a one-piece metal member. In the first embodiment, formation of the gap in the line conductor 13 is unnecessary, so that it is possible to avoid a problem of poor machining of the gap and to easily machine the line conductor 13.

The conversion unit 31, the first, second, and third impedance transforming units 32, 34, and 33, and the microstrip lines 35 each have a characteristic impedance corresponding to the line width thereof. A characteristic impedance of the conversion unit 31 is assumed to be $Z_1$ corresponding to the line width $W_1$. A characteristic impedance of the microstrip lines 35 is assumed to be $Z_0$ corresponding to the line width $W_0$. The characteristic impedance $Z_1$ is smaller than the characteristic impedance $Z_0$. A relationship of $Z_1<Z_0$ holds between the characteristic impedance $Z_1$ and the characteristic impedance $Z_0$. Since a difference in the line width between the conversion unit 31 and the microstrip lines 35 is relatively large, if the microstrip lines 35 are directly adjacent to the conversion unit 31, unnecessary radiation of electromagnetic waves increases due to mismatch between the characteristic impedance $Z_1$ and the characteristic impedance $Z_0$, which results in an increase in power loss.

The first, second, and third impedance transforming units 32, 34, and 33 are responsible for impedance matching between the conversion unit 31 and the microstrip lines 35. A characteristic impedance of the first impedance transforming units 32 is assumed to be $Z_A$ corresponding to the line width $W_A$. The characteristic impedance $Z_A$ is smaller than the characteristic impedance $Z_0$ and larger than the characteristic impedance $Z_1$. A relationship of $Z_1<Z_A<Z_0$ holds among the characteristic impedance $Z_A$, the characteristic impedance $Z_0$, and the characteristic impedance $Z_1$.

A characteristic impedance of the third impedance transforming units 33 is assumed to be $Z_B$ corresponding to the line width $W_B$. The characteristic impedance $Z_B$ is equal to the characteristic impedance $Z_0$ and larger than the characteristic impedance $Z_A$. A relationship of $Z_A<Z_B=Z_0$ holds among the characteristic impedance $Z_B$, the characteristic impedance $Z_0$, and the characteristic impedance $Z_A$. A characteristic impedance of the second impedance transforming units 34 is assumed to be $Z_C$ corresponding to the line width $W_C$. The characteristic impedance $Z_C$ is smaller than both the characteristic impedance $Z_B$ and the characteristic impedance $Z_0$, and larger than the characteristic impedance $Z_A$. A relationship of $Z_A<Z_C<Z_B=Z_0$ holds among the characteristic impedance $Z_C$, the characteristic impedance $Z_B$, the characteristic impedance $Z_0$, and the characteristic impedance $Z_A$.

In the first embodiment, the waveguide microstrip line converter 10 includes the first and second impedance transforming units 32 and 34 having a line width larger than the microstrip lines 35, and thereby impedance matching between the conversion unit 31 and the microstrip lines 35 is performed. The waveguide microstrip line converter 10 can reduce power loss by the impedance matching between the conversion unit 31 and the microstrip lines 35.

The third impedance transforming units 33 and the second impedance transforming units 34 fulfill the function of reducing impedance mismatch due to a difference in the line width between the first impedance transforming units 32 and the microstrip lines 35. The line conductor 13 includes the first, second, and third impedance transforming units 32, 34, and 33 that are portions of which the line widths differ stepwise, so that a sharp change in impedance in the propagation of electromagnetic waves can be mitigated. Thus, the waveguide microstrip line converter 10 can effectively reduce power loss. In addition, since the waveguide microstrip line converter 10 can mitigate the change in impedance in the line conductor 13, it is possible to handle signals over a wide frequency band.

The third impedance transforming units 33 are not limited to one having the same line width as the microstrip lines 35. It is satisfactory as long as the line width $W_B$ of the third impedance transforming units 33 satisfies $W_A>W_B$ and $W_C>W_B$, and the line width $W_B$ may be different from the line width $W_0$ of the microstrip lines 35. In the line conductor 13, the number of impedance transforming units that are portions having a line width larger than the microstrip lines 35 is not limited to two, and the number thereof may be one, or three or more.

The waveguide microstrip line converter 10 can transmit high-frequency signals that have been transmitted through the microstrip lines 35 to the waveguide 14. A high-frequency signal to be transmitted in the minus X direction is input to one microstrip line 35 and a high-frequency signal to be transmitted in the plus X direction is input to the other microstrip line 35. High-frequency signals having phases opposite to each other are input to both microstrip lines 35. Also in that case, the waveguide microstrip line converter 10 can reduce power loss.

The line width $W_1$ of the conversion unit 31 is narrower than a width of the open end 16 in the Y-axis direction and narrower than a width of the slot 15 in the Y-axis direction. Since the waveguide microstrip line converter 10 includes the first, second, and third impedance transforming units 32, 34, and 33, and the H-shaped slots 15, efficient power exchange can be performed even if the line width $W_1$ is set to be narrow as described above.

In the line conductor 13, regarding any portions, the line widths thereof, i.e., $W_1$, $W_A$, $W_B$, $W_C$, and $W_0$, are narrower than the width of the slot 15 in the Y-axis direction. The width of the slot 15 in the Y-axis direction is narrower than the width of the open end 16 in the Y-axis direction. As described above, in the waveguide microstrip line converter 10, the line conductors 13 and the slots 15 fall within a range of the waveguide 14 in the Y-axis direction. Thus, the waveguide microstrip line converter 10 can be miniaturized.

Figure 6:
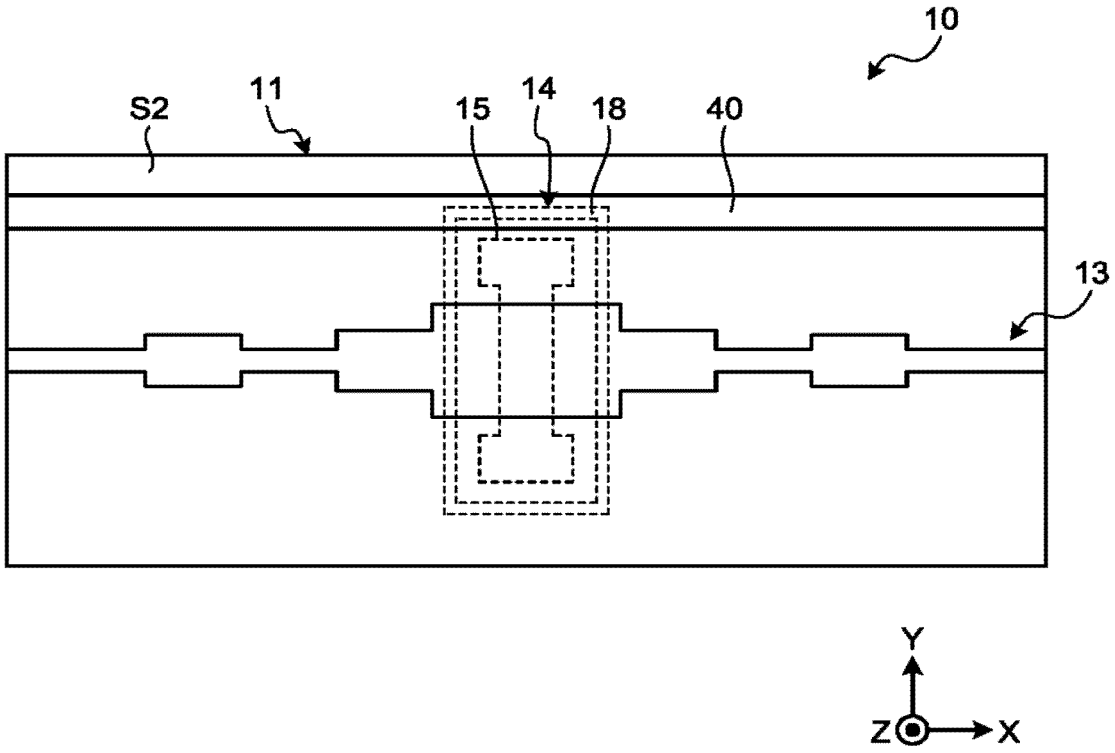
FIG. 6 is an explanatory view illustrating advantages obtained by miniaturizing the waveguide microstrip line converter illustrated in FIG. 1.

FIG. 6 is an explanatory view illustrating advantages obtained by miniaturizing the waveguide microstrip line converter 10. FIG. 6 illustrates a state in which a line 40 is added to the waveguide microstrip line converter 10 illustrated in FIG. 1. Similarly to the line conductor 13, the line 40 is provided on the second surface S2 of the dielectric substrate 11. The line 40 is provided at a position other than the position just above the slot 15 so as not to impede power exchange between the waveguide 14 and the line conductor 13.

The size of the slot 15 in the Y-axis direction can be reduced, and thereby it is possible to dispose the line 40 at a position other than the position just above the slot 15 and close to the line conductor 13. Thus, the waveguide microstrip line converter 10 can achieve a small configuration even when the line 40 is added.

According to the first embodiment, the waveguide microstrip line converter 10 includes the first, second, and third impedance transforming units 32, 34, and 33 responsible for impedance matching between the conversion unit 31 and the microstrip lines 35, so that radiation of electromagnetic waves can be reduced and power loss can be reduced. Since the waveguide microstrip line converter 10 includes the H-shaped slot 15, an electromagnetic coupling just under the conversion unit 31 is strengthened and the power is efficiently exchanged between the waveguide 14 and the line conductor 13. Thus, the waveguide microstrip line converter 10 can obtain high electric performance even if the through holes are not provided in the dielectric substrate 11.

Since the waveguide microstrip line converter 10 requires no through hole, it is possible to simplify a manufacturing process and to reduce manufacturing cost as a result that machining of the through holes is omitted. In addition, the waveguide microstrip line converter 10 can avoid a situation where electric performance is deteriorated due to breakage of the through holes, so that reliability can be improved and stable electric performance can be obtained. When the waveguide microstrip line converter 10 is used for a feeding circuit of an antenna device, the antenna device can obtain stable transmission power and reception power. Consequently, the waveguide microstrip line converter 10 can obtain stable and high electric performance, and can improve reliability.

In the waveguide microstrip line converter 10, unnecessary electromagnetic waves can be radiated from the slot 15 or from a portion of the line conductor 13 where the line width is discontinuous. In the waveguide microstrip line converter 10, phases of electromagnetic waves to be radiated may be adjusted and unnecessary radiation of electromagnetic waves in the plus Z direction that is a specific direction may be reduced by providing the slot 15 and the conversion unit 31 whose sizes in the Y-axis direction are appropriately adjusted. Also in that case, the waveguide microstrip line converter 10 can obtain high electric performance.

Figure 7:
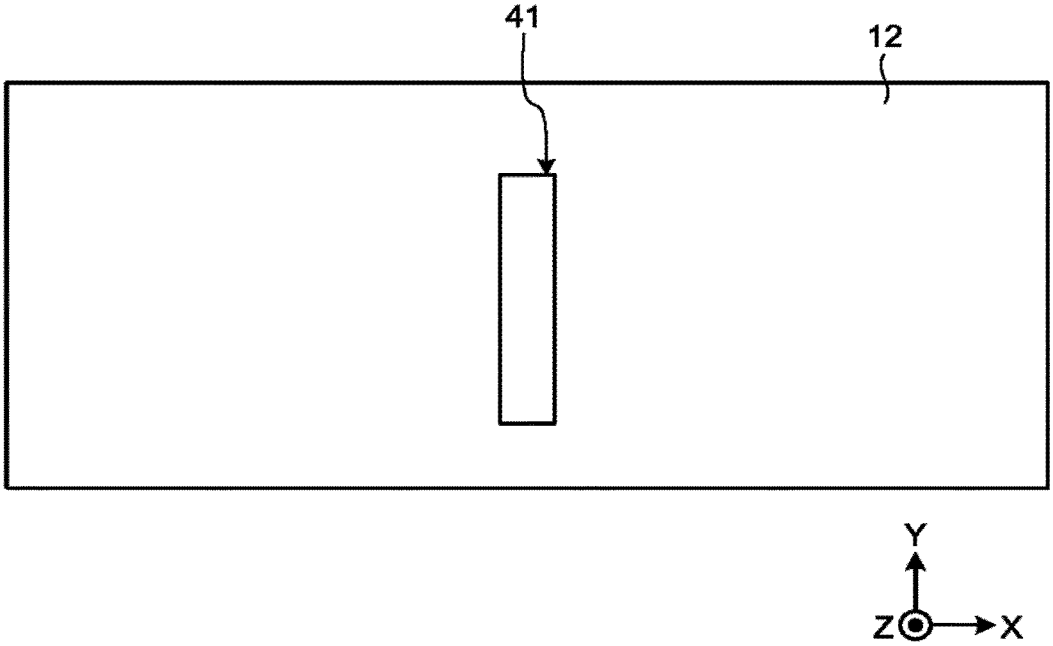
FIG. 7 is a view of a modification of a slot of the first embodiment.

The waveguide microstrip line converter 10 may include a slot of any shape as long as radiation of electromagnetic waves is acceptable. FIG. 7 is a view illustrating a modification of the slot. A planar shape of a slot 41 according to the modification is a rectangle having long sides parallel to the Y axis and short sides parallel to the X axis. The long sides of the slot 41 may be set to be longer than the width of the slot 15 in the Y-axis direction in order to achieve electric performance equivalent to that in the case where the H-shaped slot 15 is used.

Second Embodiment

Figure 8:
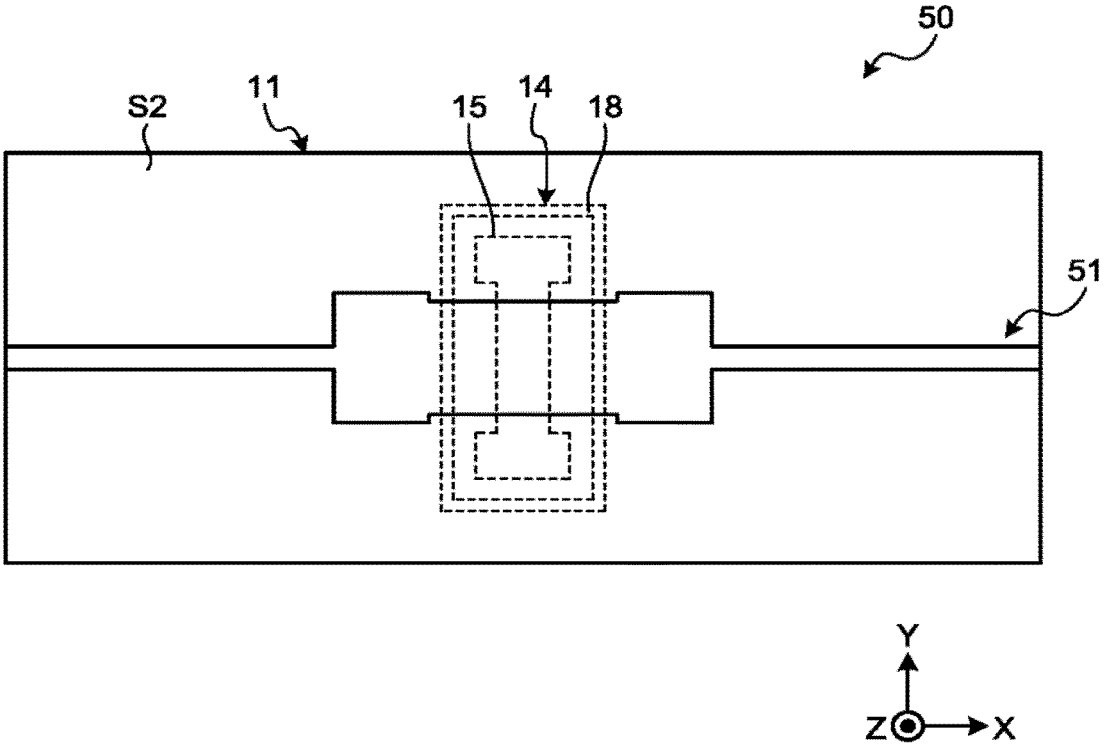
FIG. 8 is a top view illustrating an appearance configuration of a waveguide microstrip line converter according to a second embodiment.

FIG. 8 is a top view illustrating an appearance configuration of a waveguide microstrip line converter 50 according to a second embodiment. The same parts as those in the first embodiment are denoted by the same reference numerals, and duplicate descriptions thereof will be omitted. In the waveguide microstrip line converter 50 of the second embodiment, a line conductor 51 is provided instead of the line conductor 13 of the waveguide microstrip line converter 10 of the first embodiment.

Figure 9:
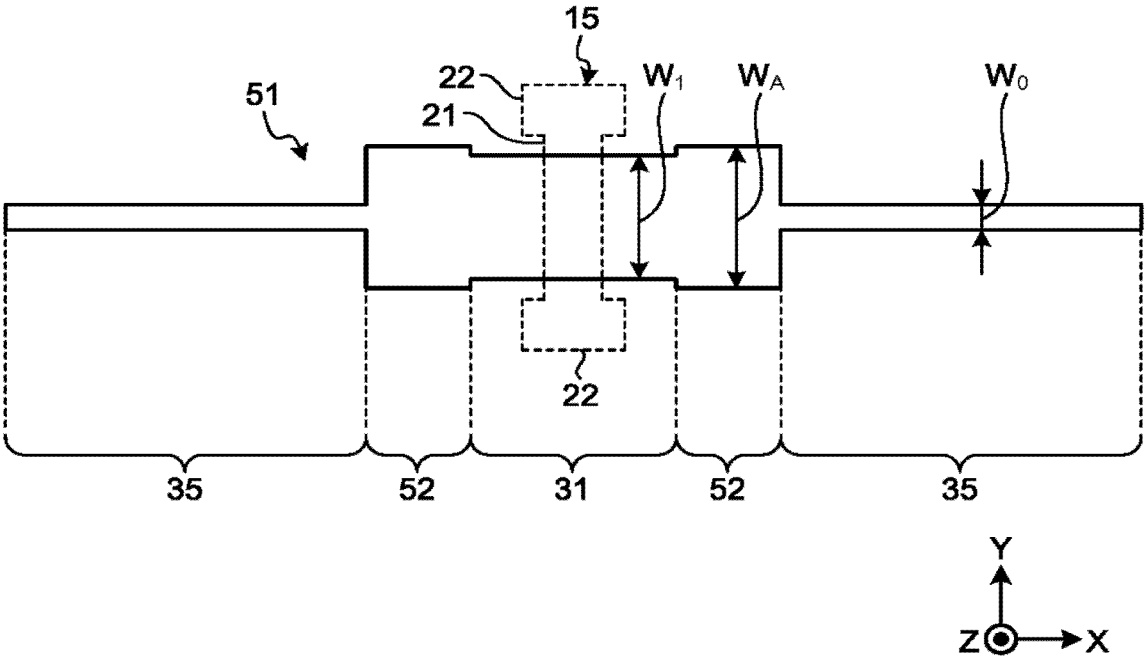
FIG. 9 is a plan view of a line conductor of the second embodiment.

FIG. 9 is a plan view of the line conductor 51. In FIG. 9, as a reference, the slot 15 is indicated by a broken line. The line conductor 51 includes first portions that are microstrip lines 35, a second portion that is a conversion unit 31 located just above the slot 15, and third portions between the first portions and the second portion. The third portions are impedance transforming units 52 responsible for impedance matching between the microstrip lines 35 and the conversion unit 31. In the second embodiment, the number of impedance transforming units in the third portions is smaller than in the first embodiment. The conversion unit 31, the impedance transforming units 52, and the microstrip lines 35 are made of a metal foil or a metal plate that is a one-piece metal member.

The impedance transforming units 52 have a line width $W_A$ and are located between the conversion unit 31 and the microstrip lines 35. The line width $W_A$ of the impedance transforming units 52 is wider than both the line width $W_0$ of the microstrip lines 35 and the line width $W_1$ of the conversion unit 31. A relationship of $W_A>W_1>W_0$ holds among the line width $W_A$, the line width $W_0$, and the line width $W_1$. A line length of the impedance transforming units 52 corresponds to $\lambda/4$.

A characteristic impedance of the impedance transforming units 52 is assumed to be $Z_A$ corresponding to the line width $W_A$. The characteristic impedance $Z_A$ of the impedance transforming units 52 is smaller than both the characteristic impedance $Z_0$ of the microstrip lines 35 and the characteristic impedance $Z_1$ of the conversion unit 31. A relationship of $Z_A<Z_1<Z_0$ holds among the characteristic impedance $Z_A$, the characteristic impedance $Z_0$, and the characteristic impedance $Z_1$. The waveguide microstrip line converter 50 includes the impedance transforming units 52 having a line width larger than the microstrip lines 35, and thereby impedance matching between the conversion unit 31 and the microstrip lines 35 is performed. The line width $W_A$ of the impedance transforming units 52 is set to be wider than the line width $W_1$ of the conversion unit 31, so that impedance matching can be performed by the impedance transforming units 52 alone.

In the line conductor 51, the line width significantly changes at a boundary between the impedance transforming units 52 and the microstrip lines 35. In the waveguide microstrip line converter 50, portions whose line widths are significantly different from each other may be adjacent to each other as long as radiation of electromagnetic waves is acceptable.

According to the second embodiment, since the waveguide microstrip line converter 50 includes the impedance transforming units 52, stable and high electric performance can be obtained and reliability can be improved. In addition, the waveguide microstrip line converter 50 can be reduced in size in the X-axis direction by reducing the number of impedance transforming units of the third portions.

Third Embodiment

Figure 10:
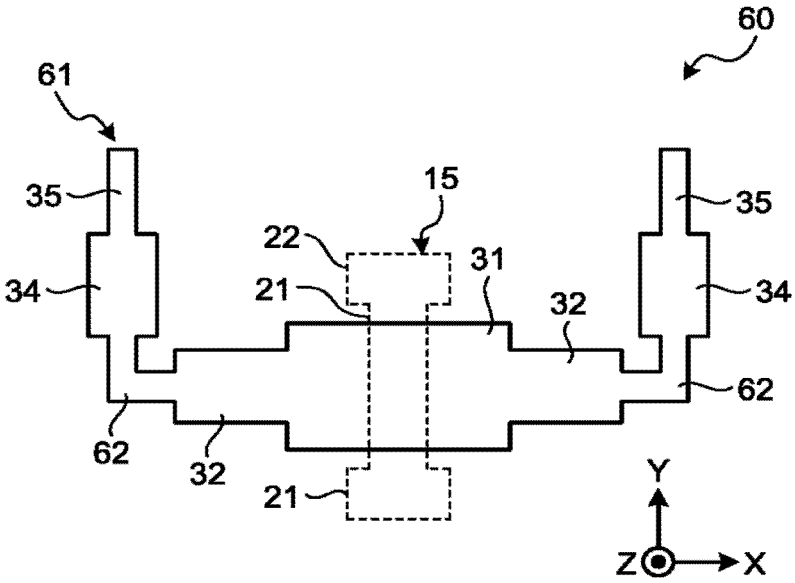
FIG. 10 is a plan view of a line conductor of a waveguide microstrip line converter according to a third embodiment.

FIG. 10 is a plan view of a line conductor 61 of a waveguide microstrip line converter 60 according to a third embodiment. The same parts as those in the first and second embodiments are denoted by the same reference numerals, and duplicate descriptions thereof will be omitted. The line conductor 61 of the waveguide microstrip line converter 60 of the third embodiment includes third impedance transforming units 62 instead of the third impedance transforming units 33 of the first embodiment. Both of the two third impedance transforming units 62 are vertically bent. In FIG. 10, as a reference, the slot 15 is indicated by a broken line.

When high-frequency signals that have been transmitted through the waveguide 14 are transmitted to the microstrip lines 35, one of the third impedance transforming units 62 transmits, in the plus Y direction, a high-frequency signal that has been transmitted in the plus X direction. The other third impedance transforming unit 62 transmits, in the plus Y direction, a high-frequency signal that has been transmitted in the minus X direction. The waveguide microstrip line converter 60 outputs high-frequency signals to be transmitted in the plus Y direction from the two microstrip lines 35. In transmitting the high-frequency signals that have been transmitted through the microstrip lines 35 to the waveguide 14, high-frequency signals to be transmitted in the minus Y direction are input to the two microstrip lines 35.

Because the first and second impedance transforming units 32 and 34 have a line width of a length close to $\lambda/4$ that is a line length, it is difficult to form the impedance transforming units 32 and 34 into a vertically bent shape. The third impedance transforming units 62 have a narrower line width than both the first and second impedance transforming units 32 and 34, and consequently, it is relatively easy to bend the third impedance transforming units 62 vertically. The waveguide microstrip line converter 60 includes the third impedance transforming unit 62, so that it is possible to obtain the line conductor 61 including a vertically bent portion. The waveguide microstrip line converter 60 includes such a bent portion, so that the size in the X-axis direction can be reduced.

According to the third embodiment, with the waveguide microstrip line converter 60, it is possible to obtain stable and high electric performance and to improve reliability similarly to the first embodiment. In addition, the waveguide microstrip line converter 60 includes the third impedance transforming units 62, so that the size in the X-axis direction can be reduced.

Figure 11:
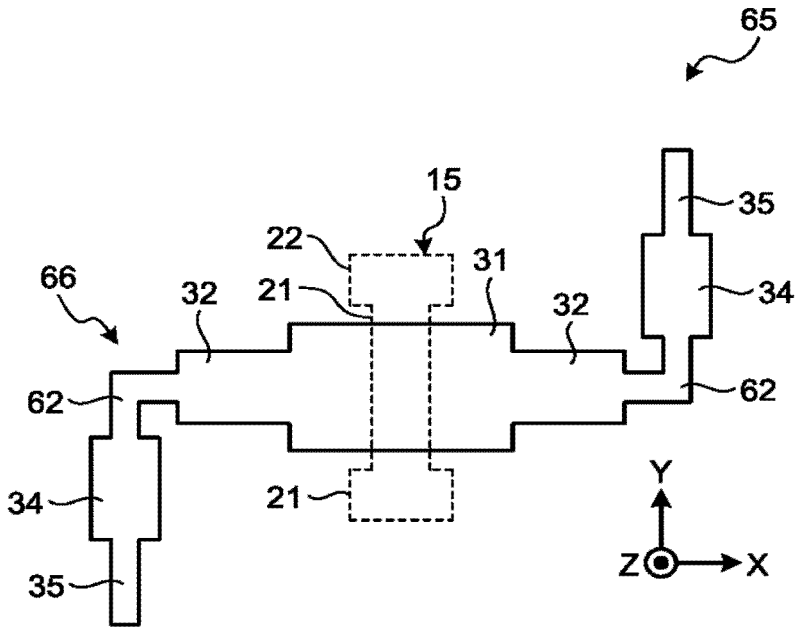
FIG. 11 is a plan view of a line conductor of a waveguide microstrip line converter according to a first modification of the third embodiment.

FIG. 11 is a plan view of a line conductor 66 of a waveguide microstrip line converter 65 according to a first modification of the third embodiment. The line conductor 66 includes two third impedance transforming units 62 bent in directions opposite to each other.

When high-frequency signals that have been transmitted through the waveguide 14 are transmitted to the microstrip lines 35, one of the third impedance transforming units 62 transmits, in the plus Y direction, a high-frequency signal that has been transmitted in the plus X direction. The other third impedance transforming unit 62 transmits, in the minus Y direction, a high-frequency signal that has been transmitted in the minus X direction. The waveguide microstrip line converter 65 outputs a high-frequency signal to be transmitted in the plus Y direction from one microstrip line 35 and a high-frequency signal to be transmitted in the minus Y direction from the other microstrip line 35.

When high-frequency signals that have been transmitted through the microstrip lines 35 are transmitted to the waveguide 14, a high-frequency signal to be transmitted in the minus Y direction is input to one microstrip line 35, and a high-frequency signal to be transmitted in the plus Y direction is input to the other microstrip line 35.

Figure 12:
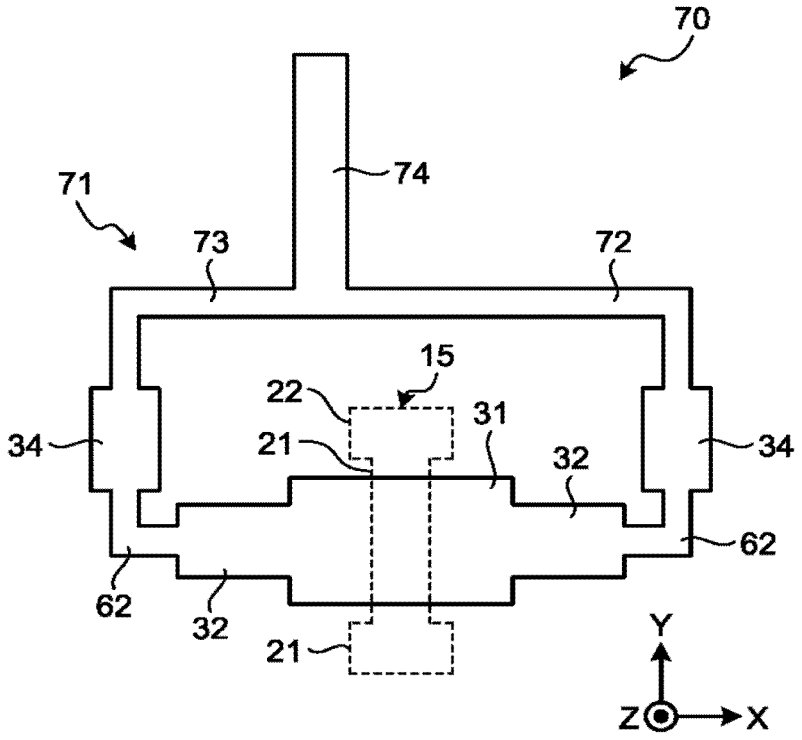
FIG. 12 is a plan view of a line conductor of a waveguide microstrip line converter according to a second modification of the third embodiment.

FIG. 12 is a plan view of a line conductor 71 of a waveguide microstrip line converter 70 according to a second modification of the third embodiment. The line conductor 71 includes, instead of the two microstrip lines 35 illustrated in FIG. 10, three microstrip lines 72, 73, and 74. Among them, the two microstrip lines 72 and 73 are vertically bent and have line lengths different from each other. The other microstrip line 74 is a transmission path connected to the two microstrip lines 72 and 73.

When high-frequency signals that have been transmitted through the waveguide 14 are transmitted to the microstrip line 74, the microstrip line 72 transmits, in the minus X direction, a high-frequency signal that has been transmitted in the plus Y direction. The microstrip line 73 transmits, in the plus X direction, a high-frequency signal that has been transmitted in the plus Y direction. The microstrip line 74 transmits the high-frequency signals joined from the two microstrip lines 72 and 73 in the plus Y direction. A difference in line length between the two microstrip lines 72 and 73 corresponds to $\lambda/2$. By making a difference in the line length between the two microstrip lines 72 and 73, high-frequency signals having the same phase are joined in the microstrip line 74.

When high-frequency signals that have been transmitted through the microstrip line 74 are transmitted to the waveguide 14, the high-frequency signals transmitted through the microstrip line 74 are divided and directed to two microstrip lines 72 and 73. The phase of the high-frequency signals that have been transmitted through the microstrip line 72 and the phase of the high-frequency signals that have been transmitted through the microstrip line 73 are opposite to each other. Furthermore, the phase of the high-frequency signals reaching the conversion unit 31 via the microstrip line 72 and the phase of the high-frequency signals reaching the conversion unit 31 via the microstrip line 73 are opposite to each other. Thus, these high-frequency signals have the same phase in the waveguide 14 and pass through the waveguide 14.

Similarly to the waveguide microstrip line converter 60, the waveguide microstrip line converters 65 and 70 of the first and second modifications can obtain stable and high electric performance and improve the reliability, and can reduce the size in the X-axis direction.

Fourth Embodiment

Figure 13:
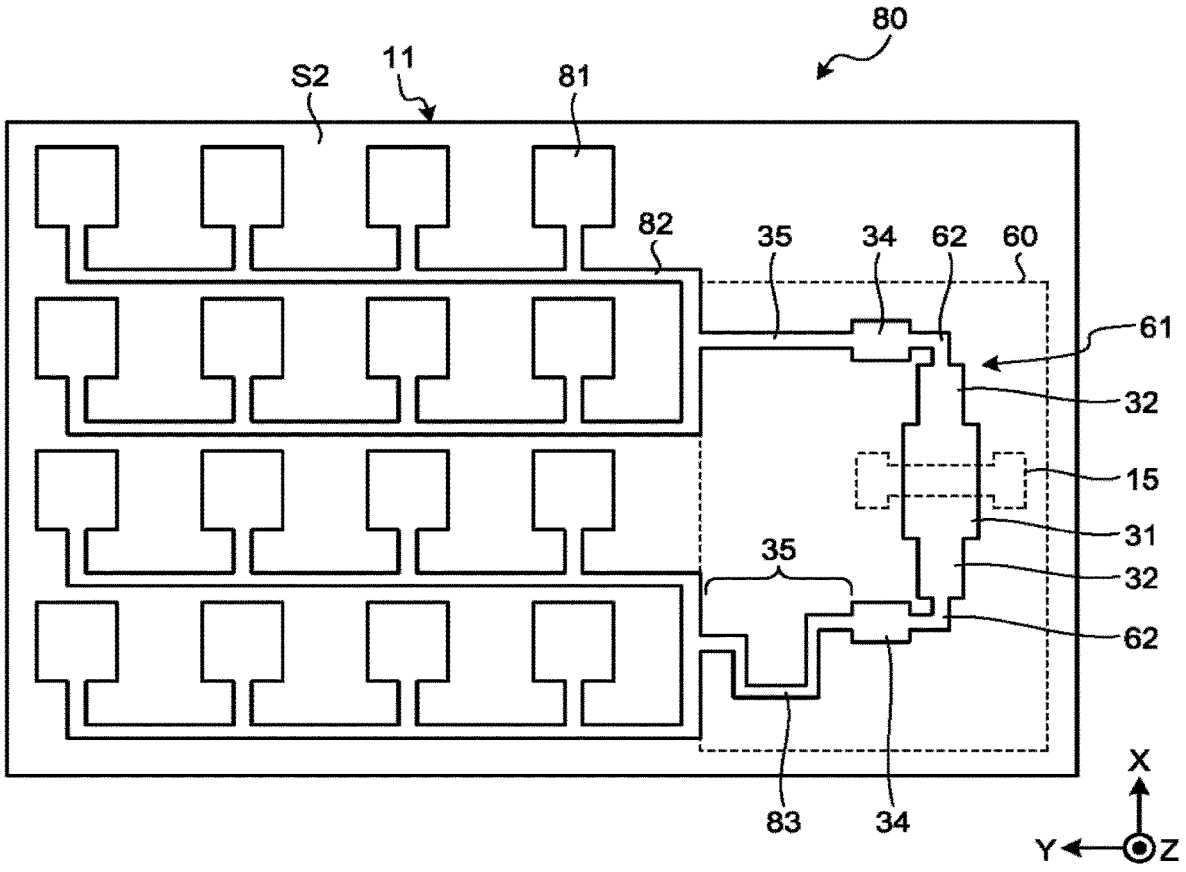
FIG. 13 is a plan view of an antenna device according to a fourth embodiment.

FIG. 13 is a plan view of an antenna device 80 according to a fourth embodiment. The antenna device 80 is a planar antenna that transmits and receives microwaves or millimeter waves, and includes the waveguide microstrip line converter 60 of the third embodiment. The same parts as those in the first to third embodiments are denoted by the same reference numerals, and duplicate descriptions thereof will be omitted.

The antenna device 80 includes the waveguide microstrip line converter 60, a plurality of antenna elements 81 and microstrip lines 82. The antenna elements 81 are arranged in an array in the X-axis direction and the Y-axis direction. Each antenna element 81 is connected to the microstrip line 35 of the waveguide microstrip line converter 60 via the microstrip line 82. The microstrip line 82 extends and branches from each of the two microstrip lines 35. Each antenna element 81 is connected to one of the two microstrip lines 35. The number of antenna elements 81 is arbitrary, and is not limited to 16, which is the number thereof illustrated in the figure.

The waveguide microstrip line converter 60 is used for a feeding circuit of the antenna device 80. A detour 83 is included in one of the two microstrip lines 35. A line length of the detour 83 corresponds to $\lambda/2$. By making a difference in line length between the two microstrip lines 35, the waveguide microstrip line converter 60 transmits high-frequency signals of the same phase from both microstrip lines 35 to the microstrip lines 82.

The line conductor 61, the antenna elements 81, and the microstrip lines 82 are formed on the second surface S2 of the dielectric substrate 11. The line conductor 61, the antenna elements 81, and the microstrip lines 82 are formed by patterning a copper foil as a one-piece metal member crimped on the second surface S2. Similarly to the case illustrated in FIG. 2, the ground conductor 12 is provided on the entire first surface S1 on a minus Z direction side of the dielectric substrate 11.

Since the line conductor 61, the antenna elements 81, and the microstrip lines 82 are disposed on the common second surface S2, they can be formed by a common process. In one example, the line conductor 61, the antenna elements 81, and the microstrip lines 82 can be formed by a film forming process and a patterning process that are common thereto. Because it is unnecessary to form the antenna elements 81 and the microstrip lines 82 of the antenna device 80 by a process separate from a formation process of the line conductor 61, it is possible to simplify a manufacturing process and to reduce manufacturing cost. The antenna elements 81 and the microstrip lines 82 each may be a metal plate formed in advance and then attached to the dielectric substrate 11.

In the fourth embodiment, the through holes of the dielectric substrate 11 between the antenna elements 81 and the ground conductor 12 are unnecessary, and similarly to the first embodiment, the through holes of the dielectric substrate 11 in the waveguide microstrip line converter 60 are unnecessary. Since machining of the through holes can be omitted in the antenna device 80, it is possible to simplify the manufacturing process and to reduce the manufacturing cost. The antenna device 80 can obtain stable transmission power and reception power, and thereby it is possible to obtain stable communication performance.

In the waveguide microstrip line converter 60, the line conductors 61 and the slots 15 fall within a range of the waveguide 14 in the Y-axis direction. The size of the waveguide microstrip line converter 60 in the Y-axis direction can be reduced, and thereby it is possible to reduce layout restrictions for arranging the waveguide microstrip line converter 60 in the antenna device 80.

According to the fourth embodiment, since the antenna device 80 includes the waveguide microstrip line converter 60, stable and high electric performance can be obtained and reliability can be improved. In addition, since the antenna device 80 includes the line conductor 61, the antenna elements 81, and the microstrip lines 82 on the second surface S2, it is possible to simplify the manufacturing process and to reduce the manufacturing cost.

Fifth Embodiment

Figure 14:
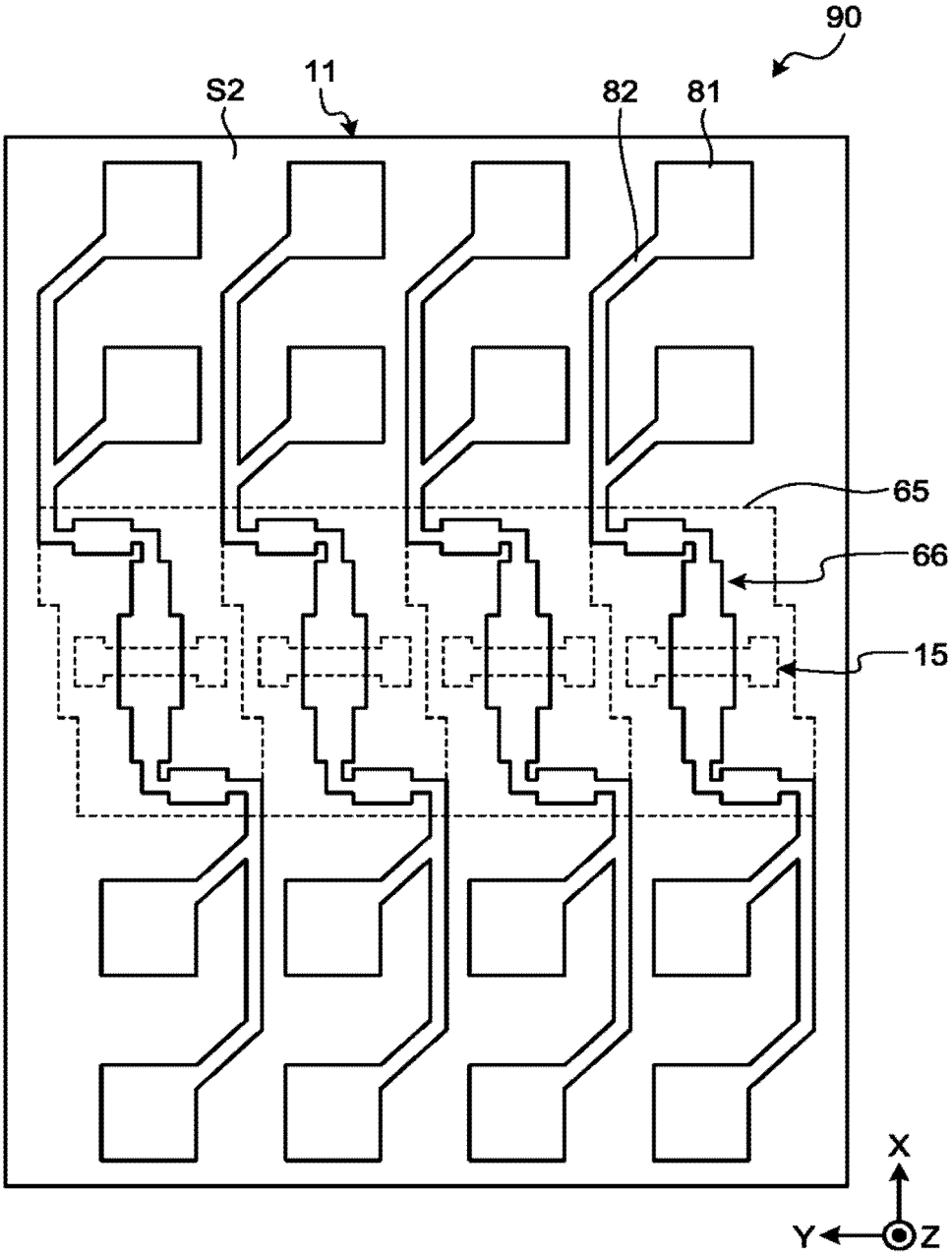
FIG. 14 is a plan view of an antenna device according to a fifth embodiment.

FIG. 14 is a plan view of an antenna device 90 according to a fifth embodiment. The antenna device 90 is a planar antenna that transmits and receives microwaves or millimeter waves, and includes the waveguide microstrip line converter 65 according to the first modification of the third embodiment. The same parts as those in the first to fourth embodiments are denoted by the same reference numerals, and duplicate descriptions thereof will be omitted.

The antenna device 90 includes the waveguide microstrip line converters 65, the antenna elements 81, and the microstrip lines 82. The waveguide microstrip line converters 65 are each used for a feeding circuit of the antenna device 90.

Four antenna elements 81 are connected to one waveguide microstrip line converter 65. Two antenna elements 81 are connected to each of the two microstrip lines 35 provided in the waveguide microstrip line converter 65 via the microstrip lines 82. The number of antenna elements 81 per waveguide microstrip line converter 65 is arbitrary, and is not limited to four. The number of waveguide microstrip line converters 65 in the antenna device 90 is arbitrary, and is not limited to four, which is the number thereof illustrated in the figure.

The line conductors 66, the antenna elements 81, and the microstrip lines 82 are formed on the second surface S2 of the dielectric substrate 11. The line conductors 66, the antenna elements 81, and the microstrip lines 82 are formed by patterning a copper foil as a one-piece metal member crimped on the second surface S2. In one example, the line conductors 66, the antenna elements 81, and the microstrip lines 82 can be formed by a film forming process and a patterning process that are common thereto. Because it is unnecessary to form the antenna elements 81 and the microstrip lines 82 of the antenna device 90 by a process separate from a formation process of the line conductors 66, it is possible to simplify a manufacturing process and to reduce manufacturing cost. The antenna device 90 can obtain stable transmission power and reception power, and thereby it is possible to obtain stable communication performance.

Since the antenna device 90 includes the waveguide microstrip line converters 65, the phases of high-frequency signals transmitted from the waveguide 14 can be controlled for each waveguide microstrip line converter 65. When transmitting electromagnetic waves, the antenna device 90 can perform beam scanning in the X-axis direction by controlling the phases of the high-frequency signals.

In each waveguide microstrip line converter 65, the line conductor 66 and the slot 15 fall within a range of the waveguide 14 in the Y-axis direction. The size of each waveguide microstrip line converter 65 in the Y-axis direction can be reduced, and thereby it is possible to reduce layout restrictions for arranging the waveguide microstrip line converters 65 in the antenna device 90. In the antenna device 90, the waveguide microstrip line converters 65 can be compactly arranged.

According to the fifth embodiment, since the antenna device 90 includes the waveguide microstrip line converters 65, stable and high electric performance can be obtained and reliability can be improved. In addition, since the antenna device 90 includes the line conductors 66, the antenna elements 81, and the microstrip lines 82 on the second surface S2, it is possible to simplify the manufacturing process and to reduce the manufacturing cost.

In the antenna devices 80 and 90 of the fourth and fifth embodiments, any of the waveguide microstrip line converters 10, 50, and 70 of the other embodiments may be provided instead of the waveguide microstrip line converters 60 and 65. The configurations of the antenna devices 80 and 90 may be provided in a radar device. The radar device can obtain stable transmission power and reception power, and thereby it is possible to obtain stable detection performance.

Sixth Embodiment

Figure 15:
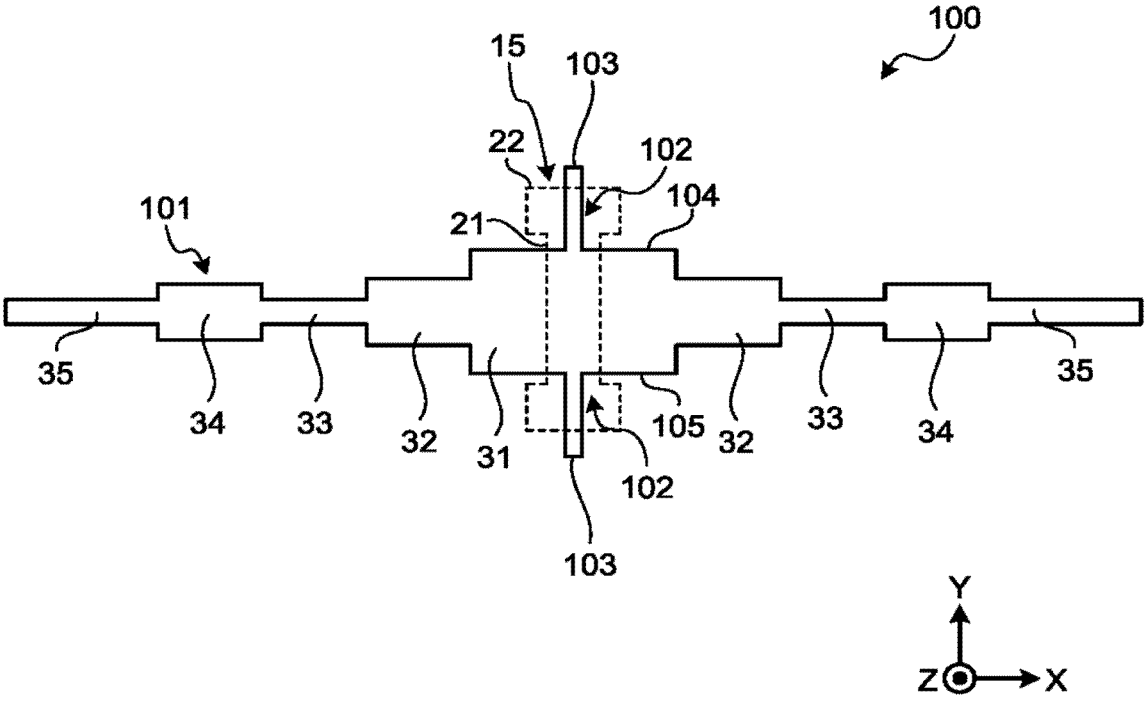
FIG. 15 is a plan view of a line conductor of a waveguide microstrip line converter according to a sixth embodiment.

FIG. 15 is a plan view of a line conductor 101 of a waveguide microstrip line converter 100 according to a sixth embodiment. The line conductor 101 is obtained by adding stubs 102 to a configuration similar to that of the line conductor 13 of the first embodiment. The same parts as those in the first to third embodiments are denoted by the same reference numerals, and duplicate descriptions thereof will be omitted.

The line conductor 101 includes two stubs 102 that are fourth portions. The two stubs 102 are provided at the central position of the conversion unit 31 in the X-axis direction. The stubs 102 extend from the conversion unit 31 that is a second portion in the Y-axis direction that is a first direction. The Y-axis direction is a direction of a line width of the line conductor 101. Each stub 102 has a tip end 103 that is an open end.

The two stubs 102 are provided at the two ends 104 and 105 of the conversion unit 31 in the Y-axis direction. The stub 102 provided at the end 104 has a linear shape with the tip end 103 oriented in the plus Y direction. The stub 102 provided at the end 105 has a linear shape with the tip end 103 oriented in the minus Y direction. A length of the stubs 102 in the Y-axis direction corresponds to $\lambda/4$.

In FIG. 15, positions of the stubs 102 coincide with the position of the center of the slot 15 in the X-axis direction. In the waveguide microstrip line converter 100 illustrated in FIG. 15, there is no misalignment between the position of the line conductor 101 and the position of the slot 15 in the X-axis direction, and the arrangement of the line conductor 101 and the slot 15 is so to speak an ideal arrangement. Since the line conductor 101 has symmetry with respect to the center of the slot 15, power propagating to the two stubs 102 is not generated. In that case, an electrical action of the waveguide microstrip line converter 100 is the same as that of the waveguide microstrip line converter 10 of the first embodiment. Therefore, the phases of the high-frequency signals output from the two microstrip lines 35 are opposite to each other similarly to the first embodiment.

Similarly to the line conductor 13 of the first embodiment, the line conductor 101 is formed by patterning a copper foil crimped on the second surface S2 of the dielectric substrate 11 illustrated in FIG. 2. The slot 15 is formed by removing a part of the ground conductor 12 crimped on the first surface S1. In such a machining process, a misalignment may occur between a pattern formed on the first surface S1 and a pattern formed on the second surface S2.

Figure 16:
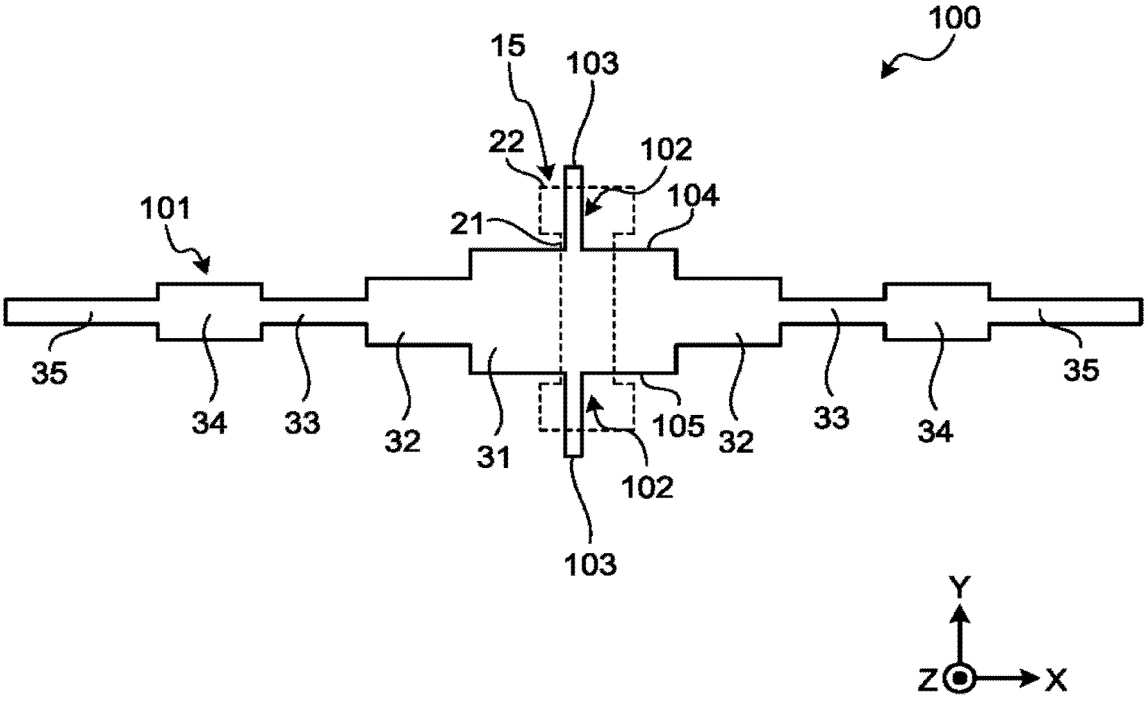
FIG. 16 is a view illustrating an example in which a position of the line conductor and a position of a slot are misaligned in the waveguide microstrip line converter illustrated in FIG. 15.

FIG. 16 is a view illustrating an example in which the position of the line conductor 101 and the position of the slot 15 are misaligned in the waveguide microstrip line converter 100 illustrated in FIG. 15. In FIG. 16, the position of each stub 102 is shifted in the minus X direction from the position of the center of the slot 15 in the X-axis direction. As described above, in the waveguide microstrip line converter 100 illustrated in FIG. 16, the position of the line conductor 101 and the position of the slot 15 in the X-axis direction are misaligned. In the waveguide microstrip line converter 100 illustrated in FIG. 16, the symmetry of the line conductor 101 with respect to the center of the slot 15 is broken.

If the stubs 102 are not provided in the waveguide microstrip line converter 100 illustrated in FIG. 16, the phases of the high-frequency signals output from the two microstrip lines 35 change from phases that are opposite to each other. When the two microstrip lines 35 are connected to the antenna elements 81 illustrated in FIG. 13, the phases of the high-frequency signals radiated from the antenna elements 81 fluctuate. Therefore, it is difficult for the antenna device 80 to obtain a desired radiation pattern.

In the sixth embodiment, since the stubs 102 are provided in the conversion unit 31, an electric field is generated in each stub 102 as the position of the line conductor 101 and the position of the slot 15 are misaligned. The tip end 103 of each stub 102 is an open end, so that a boundary condition is established where the electric field becomes zero at a connection portion between the stubs 102 and the conversion unit 31. Thus, the electrical symmetry of the line conductor 101 is secured, and thereby the phases of the high-frequency signals output from the two microstrip lines 35 are opposite to each other. As described above, the waveguide microstrip line converter 100 can reduce the influence of the misalignment between the position of the line conductor 101 and the position of the slot 15 on the high-frequency signals.

In a case where the two microstrip lines 35 of the line conductor 101 are connected to the antenna elements 81 illustrated in FIG. 13, the phases of the high-frequency signals radiated from the antenna elements 81 do not fluctuate. The antenna device 80 can significantly reduce the phase fluctuation of the high-frequency signals, and a desired radiation pattern can be obtained. With a stable radiation characteristic, the antenna device 80 can obtain stable transmission power and reception power.

Since the waveguide microstrip line converter 100 can reduce the influence of the misalignment between the position of the line conductor 101 and the position of the slot 15 on the high-frequency signals, stable and high electric performance can be obtained and reliability can be improved.

The line conductor 101 can reduce the fluctuation of the high-frequency signals by securing the electrical symmetry using the two stubs 102. The number of stubs 102 provided in the line conductor 101 may be one. The stub 102 may be provided at either the end 104 or the end 105.

Figure 17:
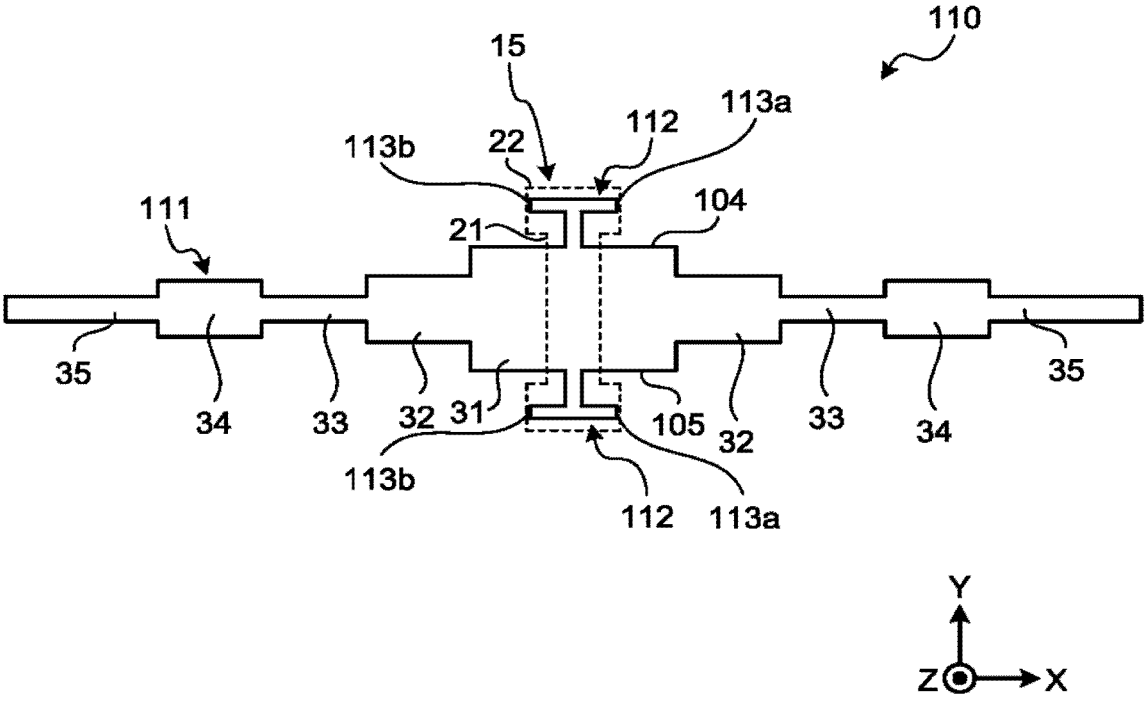
FIG. 17 is a plan view of a line conductor of a waveguide microstrip line converter according to a modification of the sixth embodiment.

FIG. 17 is a plan view of a line conductor 111 of a waveguide microstrip line converter 110 according to a modification of the sixth embodiment. The line conductor 111 of the present modification includes two stubs 112 that are fourth portions. The stubs 112 have a shape different from the stubs 102 illustrated in FIGS. 15 and 16.

The two stubs 112 are provided at a center position of the conversion unit 31 in the X-axis direction. The stub 112 provided at the end 104 includes a portion that extends in the plus Y direction from the end 104 and a portion that is orthogonal to the above-described portion and extends in the plus X direction and the minus X direction. Two tip ends 113*a* and 113*b* that are open ends are provided in the portions that extend in the plus X direction and the minus X direction. One tip end 113*a* is oriented in the plus X direction. The other tip end 113*b* is oriented in the minus X direction. The shape of the stub 112 is appropriately referred to as a "T shape".

The stub 112 has a bent shape including a portion extending in the Y-axis direction and a portion extending with the tip ends 113*a* and 113*b* oriented in the X-axis direction that is a direction other than the Y-axis direction. A length between the boundary of the end 104 and each of the tip ends 113*a* and 113*b* of the stub 112 corresponds to $\lambda/4$.

The stub 112 provided at the end 105 includes a portion that extends in the minus Y direction from the end 105 and a portion that is orthogonal to the above-described portion and extends in the plus X direction and the minus X direction. The shape of the stub 112 provided at the end 105 is the same as the shape of the stub 112 provided at the end 104.

An electrical action of the waveguide microstrip line converter 110 is similar to that of the above-described waveguide microstrip line converter 100. Since the waveguide microstrip line converter 110 can reduce the influence of the misalignment between the position of the line conductor 111 and the position of the slot 15 on the high-frequency signals, stable and high electric performance can be obtained and reliability can be improved.

By forming the stubs 112 into a bent shape, the stubs 112 can fall within a range of the slot 15 in the Y-axis direction. The waveguide microstrip line converter 110 can reduce a width of the line conductor 111 in the Y-axis direction.

The line conductor 111 can reduce the fluctuation of the high-frequency signals by securing the electrical symmetry using the two stubs 112. The number of stubs 112 provided in the line conductor 111 may be one. The stub 112 may be provided at either the end 104 or the end 105.

The shape of the stubs 112 may be a shape other than the T shape. The stubs 112 may have a "Y shape" including a portion that extends in the Y-axis direction and a portion that extends in an oblique direction from the above-described portion. Alternatively, the stubs 112 may have an "L shape" including a portion that extends, from the portion that extends in the Y-axis direction, to one of the plus X direction and the minus X direction. By forming the stub 112 into a bent shape of the "Y shape" or the "L shape", the waveguide microstrip line converter 110 can reduce the width of the line conductor 111 in the Y-axis direction.

The stubs 102 and 112 of the sixth embodiment may be provided in any of the waveguide microstrip line converters 10, 50, 60, 65, and 70 of the first to third embodiments. The antenna devices 80 and 90 of the fourth and fifth embodiments may include any of the waveguide microstrip line converters 10, 50, 60, 65, and 20 including any of the stubs 102 and 112 of the sixth embodiment.

The configurations described in the embodiments above are merely examples of the content of the present invention and can be combined with other known technology and part thereof can be omitted or modified without departing from the gist of the present invention.

REFERENCE SIGNS LIST

10, 50, 60, 65, 70, 100, 110 waveguide microstrip line converter; 11 dielectric substrate; 12 ground conductor; 13, 51, 61, 66, 71, 101, 111 line conductor; 14 waveguide; 15, 41 slot; 16 open end; 18 opening edge portion; 21 central portion; 22 end portion; 31 conversion unit; 32 first impedance transforming unit; 33, 62 third impedance transforming unit; 34 second impedance transforming unit; 35, 72, 73, 74, 82 microstrip line; 52 impedance transforming unit; 80, 90 antenna device; 81 antenna element; S1 first surface; S2 second surface; 102, 112 stub; 103, 113*a*, 113*b* tip end; 104, 105 end.

The invention claimed is:

1. A waveguide microstrip line converter capable of mutually converting power propagating through a waveguide and power propagating through a microstrip line, the waveguide microstrip line converter comprising:

a dielectric substrate;

a ground conductor provided on a first surface of the dielectric substrate and joined to an open end that is an end portion of the waveguide;

a slot formed in a region surrounded by an opening edge portion of the open end of the ground conductor; and a line conductor provided on a second surface of the dielectric substrate, wherein the line conductor includes first portions that are the microstrip lines, a second portion located just above the slot, and third portions responsible for impedance matching between the first portions and the second portion, the second portion is disposed between two of the third portions and has a wider width than a portion of the slot that is beneath the second portion, and the third portions each include an impedance transforming unit that is a portion having a wider line width than the first portions.

2. The waveguide microstrip line converter according to claim 1, wherein the impedance transforming unit has a narrower line width than the second portion.

3. The waveguide microstrip line converter according to claim 1, wherein the slot includes end portions located at both ends in a first direction that is a direction of a line width of the line conductor and a central portion between the end portions, and the end portions have a wider width than the central portion in a second direction perpendicular to the first direction.

4. The waveguide microstrip line converter according to claim 1, wherein the line conductor has a line width narrower than a width of the open end in the direction of the line width of the line conductor.

5. The waveguide microstrip line converter according to claim 1, wherein a width of the slot in the direction of the line width of the line conductor is narrower than the width of the open end in the direction of the line width.

6. The waveguide microstrip line converter according to claim 1, wherein the line conductor includes fourth portions extending from the second portion in a first direction that is the direction of the line width of the line conductor, and the fourth portions each include a tip end that is an open end.

7. The waveguide microstrip line converter according to claim 6, wherein the fourth portions are provided at two ends of the second portion in the first direction.

8. The waveguide microstrip line converter according to claim 6, wherein the fourth portions each have a bent shape in which the tip end is oriented in a direction other than the first direction.

9. A waveguide microstrip line converter capable of mutually converting power propagating through a waveguide and power propagating through a microstrip line, the waveguide microstrip line converter comprising:

a dielectric substrate;

a ground conductor provided on a first surface of the dielectric substrate and joined to an open end that is an end portion of the waveguide;

a slot formed in a region surrounded by an opening edge portion of the open end of the ground conductor; and a line conductor provided on a second surface of the dielectric substrate, wherein the line conductor includes first portions that are the microstrip lines, a second portion located just above the slot, and third portions responsible for impedance matching between the first portions and the second portion, the third portion includes a plurality of impedance transforming units, any of the impedance transforming units has a wider line width than the first portions, and the impedance transforming units include impedance transforming units having line widths different from each other.

10. The waveguide microstrip line converter according to claim 9, wherein each of the impedance transforming units has a narrower line width than the second portion.

11. The waveguide microstrip line converter according to claim 9, wherein the third portions each include a first impedance transforming unit, a second impedance transforming unit, and a third impedance transforming unit included in the impedance transforming units, and the third impedance transforming unit is provided between the first impedance transforming unit and the second impedance transforming unit, and has a narrower line width than both the first impedance transforming unit and the second impedance transforming unit.

12. The waveguide microstrip line converter according to claim 9, wherein the third portion includes the impedance transforming unit which is vertically bent.

13. The waveguide microstrip line converter according to claim 9, wherein the slot includes end portions located at both ends in a first direction that is a direction of a line width of the line conductor and a central portion between the end portions, and the end portions have a wider width than the central portion in a second direction perpendicular to the first direction.

14. The waveguide microstrip line converter according to claim 9, wherein the line conductor has a line width narrower than a width of the open end in the direction of the line width of the line conductor.

15. The waveguide microstrip line converter according to claim 9, wherein a width of the slot in the direction of the line width of the line conductor is narrower than the width of the open end in the direction of the line width.

16. The waveguide microstrip line converter according to claim 9, wherein the line conductor includes fourth portions extending from the second portion in a first direction that is the direction of the line width of the line conductor, and the fourth portions each include a tip end that is an open end.

17. The waveguide microstrip line converter according to claim 16, wherein the fourth portions are provided at two ends of the second portion in the first direction.

18. The waveguide microstrip line converter according to claim 16, wherein the fourth portions each have a bent shape in which the tip end is oriented in a direction other than the first direction.

19. A waveguide microstrip line converter capable of mutually converting power propagating through a waveguide and power propagating through a microstrip line, the waveguide microstrip line converter comprising:

a dielectric substrate;

a ground conductor provided on a first surface of the dielectric substrate and joined to an open end that is an end portion of the waveguide;

a slot formed in a region surrounded by an opening edge portion of the open end of the ground conductor; and a line conductor provided on a second surface of the dielectric substrate, wherein the line conductor includes first portions that are the microstrip lines, a second portion located just above the slot, and third portions responsible for impedance matching between the first portions and the second portion, the third portion includes a plurality of impedance transforming units, any of the impedance transforming units has a wider line width than the first portions, and the impedance transforming units include impedance transforming units having line widths different from each other, wherein each of the impedance transforming units has a narrower line width than the second portion, the third portions each include a first impedance transforming unit, a second impedance transforming unit, and a third impedance transforming unit included in the impedance transforming units, the third impedance transforming unit is provided between the first impedance transforming unit and the second impedance transforming unit, and has a narrower line width than both the first impedance transforming unit and the second impedance transforming unit, and the third impedance transforming unit is vertically bent.

20. The waveguide microstrip line converter according to claim 19, wherein the slot includes end portions located at both ends in a first direction that is a direction of a line width of the line conductor and a central portion between the end portions, and the end portions have a wider width than the central portion in a second direction perpendicular to the first direction.

* * * * *